United States Patent [19]

Wright

[11] 4,430,531

[45] Feb. 7, 1984

[54] SNAP DISC KEYBOARD

[75] Inventor: Allen J. Wright, Corvallis, Oreg.

[73] Assignee: Hewlett-Packard Company, Palo Alto, Calif.

[21] Appl. No.: 357,961

[22] Filed: Mar. 15, 1982

[51] Int. Cl.[3] ..... H01H 13/70

[52] U.S. Cl. ..... 200/5 A; 200/159 B; 200/275

[58] Field of Search ..... 200/5 R, 5 A, 159 B, 200/275, 302, 339, 340, 86 R

[56] References Cited

U.S. PATENT DOCUMENTS

| | | | |
|---|---|---|---|
| 3,819,882 | 6/1974 | Anderson et al. | 200/275 X |
| 3,916,135 | 10/1975 | Holden et al. | 200/339 X |
| 3,941,953 | 3/1976 | Misson et al. | 200/5 R |
| 4,096,364 | 6/1978 | Lynn et al. | 200/275 X |
| 4,195,210 | 3/1980 | Pounds et al. | 200/275 X |
| 4,254,309 | 3/1981 | Johnson | 200/275 X |

*Primary Examiner*—J. R. Scott

*Attorney, Agent, or Firm*—Patrick J. Barrett

[57] ABSTRACT

A metal snap disc type keyboard is disclosed having a plurality of snap discs each with a central domed portion and a peripheral foot portion. The discs are fastened together in strips to a common mounting strap having locating holes to facilitate assembly. The strips of snap discs are mounted to a printed circuit board that has corresponding conductors, and a resilient sheet is placed over this assembly. The resilient sheet provides additional key travel and cushions the harshness of the snap of the snap discs. These components are fastened into a top case in which keys are hingedly mounted for actuating the individual snap domes.

20 Claims, 8 Drawing Figures

SNAP DISC KEYBOARD

BACKGROUND OF THE INVENTION

Keyboards for electronic products such as calculators have employed a variety of different switching elements as designers have attempted to make the keyboards less expensive, more reliable and more pleasing to use. One type of commonly used switch element is the metal snap disc which comprises a metal disc that has been formed in the shape of a spherical segment. When force is applied to the center of the disc, the disc will deflect while presenting increasing resistance to deflection until a point is reached when the resistive force presented by the disc will suddenly decrease with increased deformation, and the disc will appear to the user to "snap." This action of the disc has been likened to the action of an oil can or a toy "cricket."

Numerous prior art references show snap discs as keyboard switch elements, such as U.S. Pat. No. 3,684,842 by Boulanger granted Aug. 15, 1972 and U.S. Pat. No. 3,967,084 by Pounds granted June 29, 1976. In these patents, a substrate such as a printed circuit board is provided to support the discs and conductors are provided on the substrate to make contact with the discs. Usually the conductors are arranged so that the discs form a bridging switch contact between two conductors. One of the disadvantages of using snap discs as switch elements is that the discs must be placed one at a time on the supporting substrate during assembly of the keyboard. This procedure is time consuming and error prone, leading to undesirably high assembly costs. Various means of solving such problems have been proposed. One such proposal comprises forming a plurality of discs in a single sheet of material, as in U.S. Pat. No. 3,590,195 by Driver granted June 29, 1971 and U.S. Pat. No. 3,643,041 by Jackson granted Feb. 15, 1972. Another proposal comprises forming the discs out of a single sheet of material and then removing some of the material, leaving the discs joined by parallel strips of material as in U.S. Pat. No. 3,952,174 by Boulanger et al granted Apr. 20, 1976. Further examples of keyboards with metal snap type switch elements and keys for actuating them are shown in U.S. Pat. No. 3,941,953 by Misson et al. granted Mar. 2, 1976 and U.S. Pat. No. 3,916,135 by Holden et al. granted Oct. 28, 1975.

The aforementioned approaches to improved speed of assembly are offset by a reduction in the snap feel or tactile response provided by the disc. This reduction occurs in part because the disc is constrained by the surrounding material. In addition, these discs are commonly actuated directly by a plunger type key that rests directly on the top of the disc. When such a key is actuated, the key travel is relatively short and the feel is relatively harsh. Furthermore, the cost of tooling is undesirably high for the type of keyboard with the discs formed in a single sheet of material.

SUMMARY OF THE INVENTION

In accordance with the preferred embodiment of the present invention, a keyboard is provided having snap disc switching elements which have domed central portions and peripheral foot portions. Each disc is joined to a single strap by a pair of tabs and is located in position on a supporting substrate by means of holes in the strap and mating locating pins. The locating pins can also be used to fasten the discs to the substrate. A sheet of resilient material is placed over the discs and hingeably mounted keys act on the discs through the resilient sheet.

The use of a strap facilitates the use of automatic assembly equipment in the assembly of the keyboards, and by using only a single strap, reduction of the tactile response by the strap is reduced. The foot portion of the disc is formed by making a crease in the dome near the periphery of the disc, and this foot portion increases both the key travel and the tactile response provided by the disc. Key travel is further increased by the use of the resilient sheet, which also decreases the harshness of the tactile feel of a metal snap disc.

DESCRIPTION OF THE PREFERRED EMBODIMENT

Figure 1:
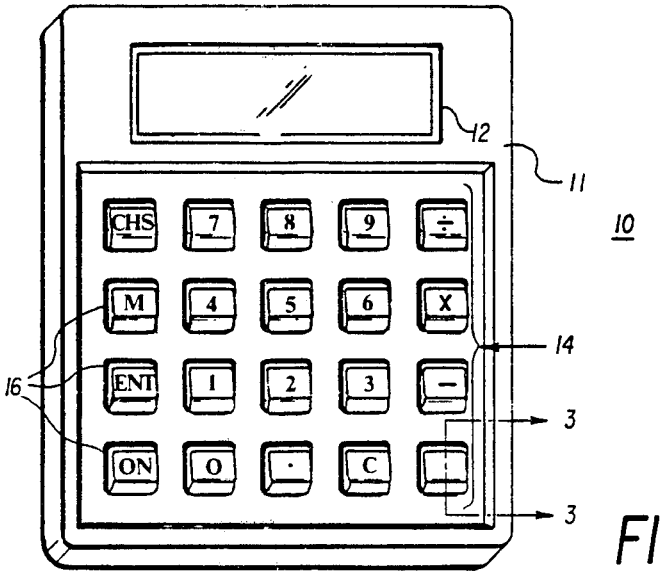
FIG. 1 shows a top view of an electronic calculator.

An electronic calculator 10 shown in FIG. 1 has a top case 11 with a display 12 and a keyboard 14. In the keyboard there is a plurality of keys 16 protruding through openings 26 in the top case.

Figure 2:
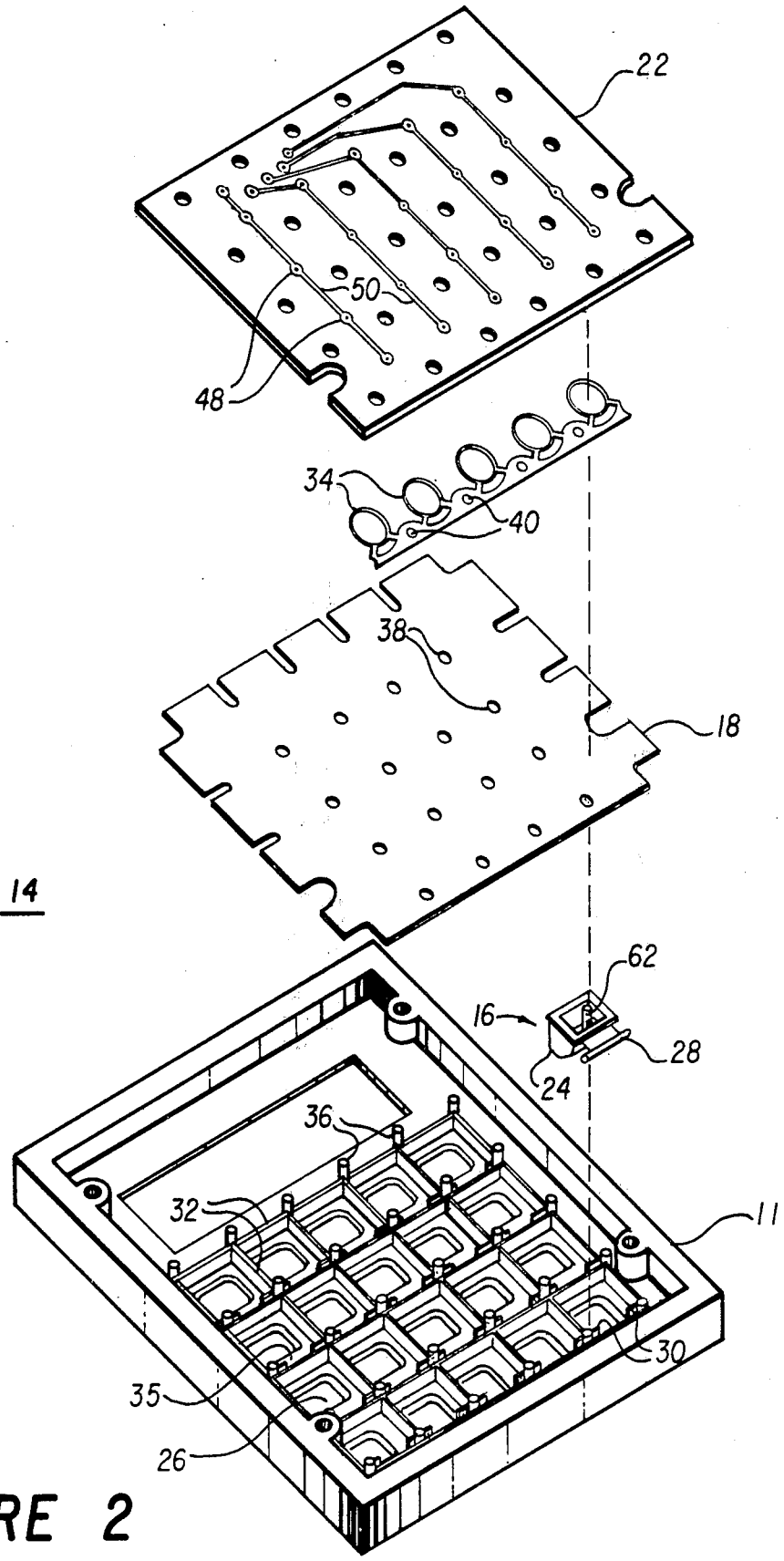
FIG. 2 shows an exploded view of the preferred embodiment of the present invention.

FIG. 2 is an exploded view of keyboard 14 showing top case 11, one key 16, a resilient sheet 18, a strip of snap discs 20 and a printed circuit board 22. These same components are shown in cross section in FIG. 3A. Key 16 has a key top portion 24 which protrudes through opening 26 in top case 11. The key also has a hinge portion 28 which is retained by and pivots in a journal portion 30 of top case 11.

There is a frame 32 around each opening 26 to provide a support surface for resilient sheet 18 and printed circuit board 22, as well as providing a recess 35 in which each snap disc 34 is located. A plurality of locating pins 36 is attached to the top case, and preferrably one locating pin is located at each corner of a recess 35 so that there are four locating pins around each snap disc.

Resilient sheet 18 is made of Neoprene in the preferred embodiment although it could be made of other resilient materials such as silicone rubber. The purpose of the resilient sheet is to provide some additional key travel due to the compresibility of the sheet and to cushion the snap of the snap disc so that the tactile feel provided to the user is not as harsh as it would be without the resilient sheet. A plurality of holes 38 is formed in resilient sheet in register with locating pins 36 to allow the resilient sheet to lay on the surface of frame 32.

Figure 4:
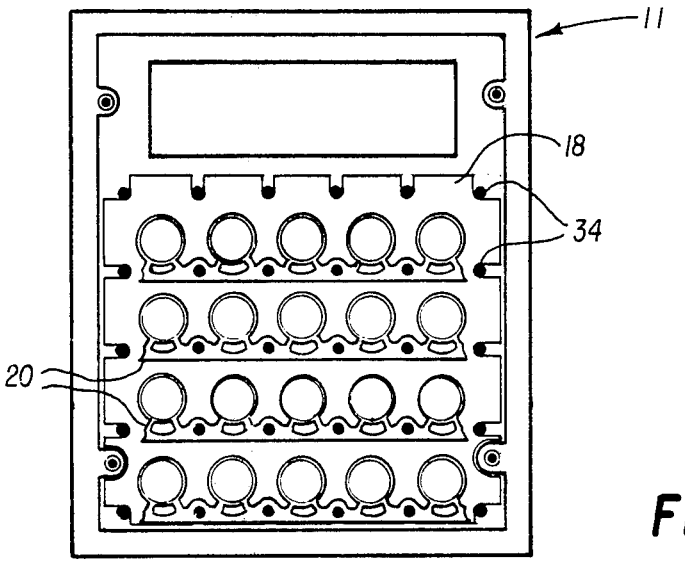
FIG. 4 shows a plan view of a partially assembled keyboard.

Each strip of snap discs 20 also has a plurality of holes 40 for engaging one row of locating pins 36 to locate each snap disc in proper relationship with the keys 16 and the printed circuit board 22. A plan view of resilient sheet 18 and strips of snap discs 20 assembled onto locating pins 36 in top case 11 is shown in FIG. 4.

Figure 5:
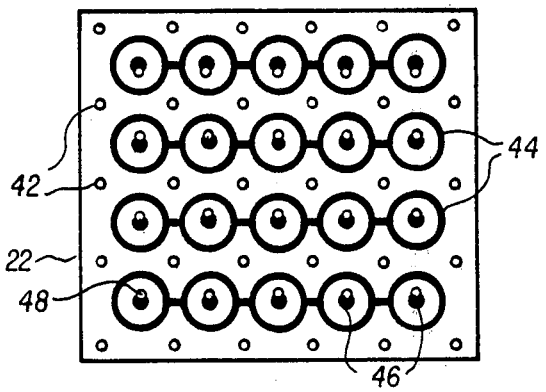
FIG. 5 shows a top view of a printed circuit board for a keyboard.

Printed circuit board 22 likewise has a plurality of holes 42 in register with locating pins 34. FIG. 5 shows a top view of printed circuit board 22 which has annular conductors 44 supported on it. As is further described below, each annular conductor 44 supports and makes electrical contact with a peripheral portion of a snap disc 34. As the snap discs are connected together in rows, the annular conductors are also connected together in rows, facilitating connection of the keyboard to electronic circuitry (not shown). FIG. 5 also shows center conductors 46 in the center of each annular conductor 44. Each center conductor 46 has a plated-through hole 48 to electrically connect the center conductor to one of several column conductors 50 on the bottom side of printed circuit board 22. These column conductors also facilitate the connection of the keybaord to electronic circuitry.

Figure 6:
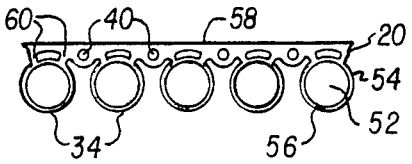
FIG. 6 shows a plan view of the preferred embodiment of a strip of snap discs.
Figure 7:
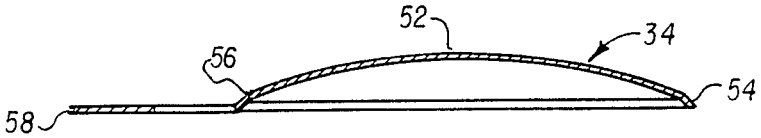
FIG. 7 shows a cross sectional view of the preferred embodiment of a snap disc.

A strip of snap discs 20 is shown in plan view in FIG. 6 and an individual snap disc is shown in cross section in FIG. 7. Each snap disc 34 has a central domed portion 52 and a peripheral foot portion 54. The foot portion is formed by a crease 56 in the disc near its periphery, such that the foot portion forms an acute angle with a tangent to the outer surface of the central domed portion at the crease. The annular surface of the foot portion is relatively small compared to the surface of the central domed portion and is in approximately the shape of a section of a cone.

The foot portion of the snap disc contributes to improved snap by decreasing the effective diameter of the portion of the disc that actually snaps, without decreasing, and in fact slightly increasing, the height of the center of the snap disc above center conductor 46. The foot portion also acts to bias the dome portion so that the disc will snap back after a deflecting force has been removed from it, thus avoiding the problem encountered with some prior art snap discs that would sometimes not snap back when the deflecting force was removed. It has been found empirically that the diameter of the central domed portion is the most important dimension in determining the amount of snap or tactile feel produced by the snap dome. Tactile feel can be made repeatable from disc to disc by keeping the diameter of the domed portion consistent. Although the height of crease 56 above the surface on which the snap disc rests is not critical, it is desirable to keep the height consistent in order to keep the key travel consistent from key to key.

As shown in FIG. 6, each snap disc 34 is joined to a strap 58 by a pair of tabs 60. Although one tab could be used to attach each snap disc to strap 58, it is preferrable to use two to restrain the discs from twisting during handling by automatic assembly equipment. Holes 40 are located between each pair of discs. The strips of snap discs can be formed from a single piece of material by stamping using a progressive die to form the holes and remove the material around the discs and then to form the domed shape and crease in the discs. In the preferred embodiment the discs are formed out of 302 stainless steel, but any 300 series stainless steel would be suitable. The material used in the preferred embodiment is 3 mils thick and full hard with a yield strength of 200,000 psi. Each of the discs is 0.350 inch in diameter and the control domed portion is 0.325 inch in diameter.

Figure 3A:
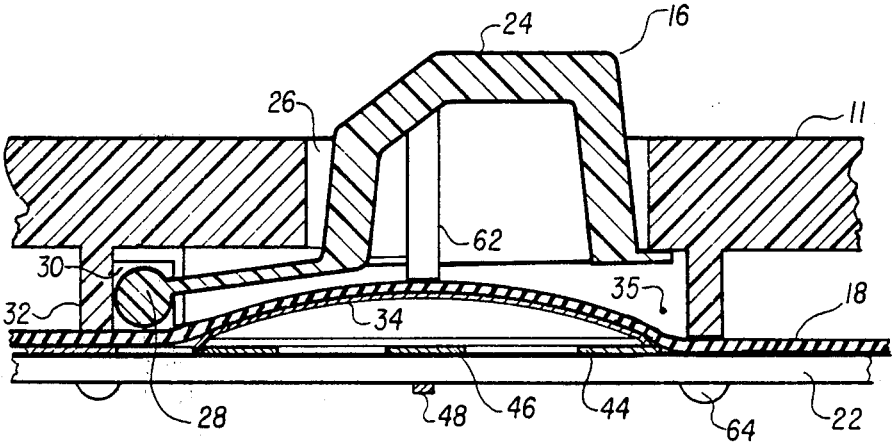
FIGS. 3A and 3B show cut-away side views of the preferred embodiment of the present invention in the deflected and undeflected positions.
Figure 3B:
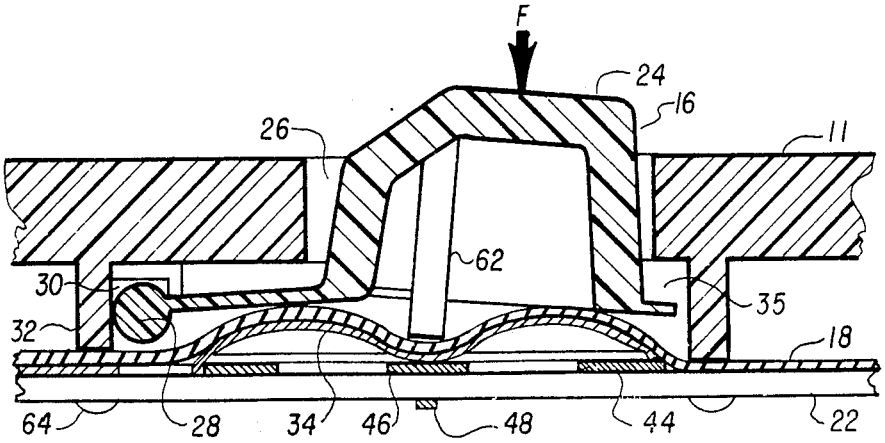

As shown in FIGS. 3A and 3B, key 16 has a force applying pin 62 that applies force from a user's finger to the center of the domed portion of the snap disc. Where the pin makes contact with the resilient sheet over the snap disc it is cylindrical in cross section and flat on the bottom. It has been found that better tactile response is achieved when the pin diameter is relatively small as compared with the diameter of the snap disc. It also appears to be advantageous to use a hinged type key as illustrated rather than the plunger type keys illustrated in the references cited above in the Background section. FIG. 3B shows the position of the key and the shape of the snap disc when a deflecting force F is applied to the key.

When a keyboard in accordance with the preferred embodiment is assembled, the components are placed in the top case in the order shown in FIG. 2, going from bottom to top. After all of the components have been placed over locating pins 36, the assembly is fastened together by heat staking the pins to form heads 64 on the pins. This fastening procedure holds the snap discs tightly against the printed circuit board so that the foot portion of each disc is in good electrical contact with an annular conductor 44. Alternate fastening procedures that can be used include self adhesive Mylar tape applied over the strips of snap discs and the printed circuit board to hold these two components together. This assembly, together with the resilient sheet, can then be fastened into the top case by means of screws or heat staking, for example. The printed circuit board, snap dome strip and resilient sheet assembly fastened against frame 32 also serves to retain keys 16 in journal portions 30.

I claim:

1. A keyboard for an electronic device comprising:

an insulative substrate;

a plurality of first conductors supported on the substrate;

a plurality of second conductors supported on the substrate;

a plurality of metal discs each having a central domed portion and a peripheral foot portion formed at an acute angle to the adjacent surface of the domed portion, each metal disc being arranged in a facing relationship with one of the first conductors and the foot portion of each metal disc being supported on the substrate by one of the second conductors;

a strap having tab means for attaching two or more of the metal discs to the strap, each disc being attached to a single strap;

a sheet of resilient material overlaying the plurality of metal discs;

a plurality of keys, each key supported over one of the metal discs for applying force to the disc through the resilient sheet when the key is depressed by a user, wherein the disc snaps and makes contact with the corresponding first conductor in response to applied force, the resilient sheet is compressed by the key and cushions the snap action of the disc for better tactile feel, and the disc snaps back to its original shape when the applied force is removed.

2. A keyboard as in claim 1 wherein the discs are arranged in rows and a plurality of the discs in a row are attached to the same strap.

3. A keyboard as in claim 1 wherein the foot portion of each disc is in the shape of a section of a cone.

4. A keyboard as in claim 1 further comprising a housing member wherein each of the keys includes a hinge portion retained in a hinge portion of the housing member and the substrate is attached to the housing member.

5. A keyboard as in claim 4 wherein each key applies force to the center portion of the corresponding metal disc.

6. A keyboard as in claim 5 wherein:

the housing member has a plurality of mounting pins;

each strap has a plurality of holes engaging corresponding mounting pins on the housing member;

the resilient sheet and the substrate each having holes corresponding to and engaging the mounting pins; and the straps, the resilient sheet and the substrate are fastened to the housing member on the mounting pins.

7. A keyboard as in claim 6 wherein:

the substrate comprises a printed circuit board, each of the first conductors comprises a printed circuit pad and a plated through hole in the printed circuit board; and each of the second conductors comprises an annular printed circuit conductor, the diameter of the annulus corresponding to the diameter of the foot portion of the corresponding metal disc.

8. A keyboard as in claim 7 wherein each of the mounting pins is heat staked to the substrate.

9. A keyboard as in claim 8 wherein each key has an actuating pin for contacting the center portion of the corresponding metal disc.

10. A keyboard as in claim 5 wherein:

the housing member has a plurality of mounting pins;

each strap has a plurality of holes engaging corresponding mounting pins on the housing member;

the resilient sheet and the substrate each having holes corresponding to and engaging the mounting pins; and the straps, the resilient sheet and the substrate are located in the housing member by the mounting pins.

11. A keyboard as in claim 10 wherein the metal discs are held to the substrate by an overlying flexible, adhesive layer.

12. A keyboard for an electronic device comprising:

an insulative substrate;

a plurality of first conductors supported on the substrate;

a plurality of second conductors supported on the substrate;

a plurality of metal discs each having a central domed portion and a peripheral foot portion, the peripheral foot portion being formed by an annular crease in the disc, each metal disc being arranged in a facing relationship with one of the first conductors and the foot portion of each metal disc being supported on the substrate by one of the second conductors;

a strap having tab means for attaching two or more of the metal discs to the strap, each disc being attached to a single strap;

a sheet of resilient material overlaying the plurality of metal discs;

a plurality of keys, each key supported over one of the metal discs for applying force to the disc through the resilient sheet when the key is depressed by a user, wherein the disc snaps and makes contact with the corresponding first conductor in response to applied force, the resilient sheet is compressed by the key and cushions the snap action of the disc for better tactile feel, and the disc snaps back to its original shape when the applied force is removed.

13. A keyboard as in claim 12 wherein the discs are arranged in rows and a plurality of the discs in a row are attached to the same strap.

14. A keyboard as in claim 12 wherein the foot portion of each disc is in the shape of a section of a cone.

15. A keyboard as in claim 12 further comprising a housing member wherein each of the keys includes a hinge portion retained in a hinge portion of the housing member and the substrate is attached to the housing member.

16. A keyboard as in claim 15 wherein each key applies force to the center portion of the corresponding metal disc.

17. A keyboard as in claim 16 wherein:

the housing member has a plurality of mounting pins;

each strap has a plurality of holes engaging corresponding mounting pins on the housing member;

the resilient sheet and the substrate each having holes corresponding to and engaging the mounting pins; and the straps, the resilient sheet and the substrate are fastened to the housing member on the mounting pins.

18. A keyboard as in claim 17 wherein:

the substrate comprises a printed circuit board;

each of the first conductors comprises a printed circuit pad and a plated through hole in the printed circuit board; and each of the second conductors comprises an annular printed circuit conductor, the diameter of the annulus corresponding to the diameter of the foot portion of the corresponding metal disc.

19. A keyboard as in claim 18 wherein each of the mounting pins is heat staked to the substrate.

20. A keyboard as in claim 19 wherein each key has an actuating pin for contacting the center portion of the corresponding metal disc.

* * * * *